US005406899A

United States Patent [19]

Albers

[11] Patent Number: 5,406,899

[45] Date of Patent: Apr. 18, 1995

[54] FABRIC REST BOARD FOR A SERGER MACHINE

[76] Inventor: Venita Albers, 4862 SE. Bayshore Ter., Stuart, Fla. 34997

[21] Appl. No.: 128,526

[22] Filed: Sep. 29, 1993

[51] Int. Cl.[6] ..... D05B 3/04; D05B 75/00

[52] U.S. Cl. ..... 112/260; 112/160

[58] Field of Search ..... 112/260, 160; 108/90, 108/157; 312/140.4, 208.5

[56] References Cited

U.S. PATENT DOCUMENTS

| | | | |
|---|---|---|---|
| 1,216,945 | 2/1917 | Christie | 312/140.4 X |
| 1,223,075 | 4/1917 | Kidder | 108/90 X |
| 4,168,671 | 9/1979 | Roberts et al. | 112/260 X |
| 4,314,517 | 2/1982 | Kasahara et al. | 112/260 |
| 5,119,745 | 6/1992 | Terry | 112/121.24 |
| 5,251,556 | 10/1993 | Ravenelle et al. | 112/260 |

FOREIGN PATENT DOCUMENTS

| | | | |
|---|---|---|---|
| 518727 | 3/1955 | Italy | 112/260 |
| 148362 | 1/1955 | Sweden | 112/260 |

OTHER PUBLICATIONS

Clotilde, Fall 1993, p. 16 (see, item #3277, "Sew Steady") Sep. 21, 1993.

Nancy's Notions, Catalog #21 p. 63 (see, "Sew Steady") Oct. 1993.

*Primary Examiner*—Clifford D. Crowder
*Assistant Examiner*—Paul C. Lewis
*Attorney, Agent, or Firm*—Malin, Haley, DiMaggio, Crosby

[57] ABSTRACT

A fabric rest board for use with a serger machine. The fabric rest board is an L-shaped, substantially flat, rigid piece. One leg of the L-shaped fabric rest board is positioned to extend substantially in parallel with, and along or adjacent to, an edge of a work table. The other leg of the L-shaped piece extends substantially perpendicular from the edge of the work table adjacent a bag attached to the serger machine for collecting cut pieces of fabric. The serger machine rests on the leg of the support piece which extends substantially parallel with, and along or adjacent to, the edge of the work table. The weight of the serger machine fixes the position of the fabric rest board on the work table. The operator uses the perpendicular leg to rest the fabric as the fabric is moved through the serger machine. The fabric is thereby prevented from falling between the serger machine and the operator which, if this occurs, can cause incorrect cuts or stitches.

6 Claims, 2 Drawing Sheets

FABRIC REST BOARD FOR A SERGER MACHINE

BACKGROUND OF THE INVENTION

1. Field of the Invention

The present invention relates to a fabric rest board for a serger machine.

2. Description of the Background Art

A serger machine is typically an industrial machine used for special cutting/sewing operations. Specifically, serger machines are used to cut fabric, such as the hem of a garment, while sewing the cut edge in overlapping securement to prevent unravelling of the edge and to enhance the appearance of the garment.

Most conventional serger machines are industrial machines for use in factories. However, light weight, less expensive serger machines are being developed for use in the home. These serger machines are considerably lighter, more compact and less expensive than their industrial counterparts. However, they present special problems associated with use in the home.

The serger machine for use in the home must be positioned at or near the edge of a table or support on which the serger machine rests so that the cut pieces or remnants of fabric fall into a bag or receptacle attached to the front of the machine. Since the serger machine is positioned at the edge of the table, most of the fabric hangs down between the front edge of the table and the operator. The operator is forced to hold the fabric in his/her lap and between his/her knees and the front edge of the table so the fabric in the machine, i.e., the fabric being cut and stitched, is not pulled by its own weight from between the feeder-dogs of the serger machine producing an incorrect cut or stitch. The moves which the operator must perform in maintaining the position of the fabric are difficult, awkward and tiresome. Accordingly, serger machines for use in the home cannot be operated continuously for long periods of time.

Serger machines are different from sewing machines in various respects, and the conventional rest boards that are used with sewing machines are, therefore, not readily adapted for use with serger machines. For example, serger machines include a cutting blade for cutting excess material as the fabric is sewn. The excess material falls into and is collected in a bag which is attached to, and hangs in front of and below, the serger machine. Sewing machines do not employ a bag which would interfere with the position or shape of the rest board, and rest boards which are designed to be used with sewing machines are, therefore, not easily modified or adapted for use with serger machines. Further, unlike sewing machines, serger machines have an access area positioned on one side of the serger machine below the work surface. The operator accesses this area frequently to remove debris accumulating from the cut pieces and to maintain the condition of the cutting blade. Sewing machines do not have the same access area nor do they require such frequent access below the level of the work surface. Conventional rest boards designed for use with sewing machines are positioned level with the work surface, and the operator must, therefore, reach under the rest board or, in the alternative, remove the rest board to obtain access to the lower portion of the sewing machine. By way of contrast, a rest board for a serger machine should allow the operator to quickly and easily access the lower portion of the machine. Another important difference between sewing machines and serger machines is that the cutting blade in a serger machine is typically aligned to cut in one direction. A piece of fabric is fed through the serger machine in a straight line (generally from the front of the machine, i.e., between the operator and the serger machine) to achieve the proper cut and stitch, whereas the fabric run through a sewing machine can be fed from the operator's left or right side, or at almost any angle with respect to the sewing machine and the sewing needle. Thus, unlike sewing machines, fabric rest boards for serger machines should provide a forward projecting rigid board on which to rest the fabric as it is run through the serger machine. Because of these and other differences, serger machines require their own special attachments in order to increase the ease in which they are operated and, therefore, to enhance their performance.

Some conventional fabric rest boards employ a U-shaped design with four legs to support the rest board at the same level as the working surface of the sewing machine. Two of the legs are positioned in front of the sewing machine between the sewing machine and the operator. However, since serger machines must be positioned at or near the edge of the support table to accommodate the bag for collecting cut pieces of fabric, there is no room on the support table to support the legs of the conventional fabric rest board. Thus, these conventional fabric rest boards are not intended, nor can they be readily adapted, for use with a serger machine. In fact, the inventor is not aware of any such devices for use with a serger machine.

SUMMARY OF THE INVENTION

It is an object of the invention to provide a fabric rest board which can be used with a serger machine to prevent fabric material from falling between the operator and the serger machine and being torn or cut by the serger machine.

It is another object to provide an inexpensive, cost effective fabric rest board for use with a portable serger machine designed for the home.

These objects are achieved with an L-shaped, flat, rigid plate as the fabric rest board, one leg of which is positioned along, and adjacent to, the edge of a work table, the other leg protruding substantially perpendicularly in front of the serger machine towards the operator.

The serger machine is placed on top of the leg that extends in parallel with the edge of the work table, the protruding leg extending towards the operator and to one side of the bag used to collect the cut pieces of fabric. The fabric rest board is, therefore, substantially L-shaped.

The weight of the serger machine is sufficient to fix the rest board on the work table. Since the fabric rest board is positioned beneath the serger machine, the fabric rest board does not interfere with the operator's access to the cutting blade or other portions of the serger machine beneath the working surface.

The fabric rest board of the present invention enables the operator to hold the fabric on the protruding leg of the fabric rest board between the operator and the serger machine prior to moving the fabric through the serger machine. It is, therefore, no longer necessary for the operator to hold the fabric in his/her lap and against the edge of the work table with his/her knees or elbows, a maneuver which is difficult, awkward and tiresome.

Further, the fabric rest board of the present invention eliminates, or at least substantially reduces, the potential for improperly cutting or tearing the fabric since the rest board prevents the fabric from falling to the ground and being pulled from between the feeder dogs of the serger machine.

BRIEF DESCRIPTION OF THE DRAWINGS

The instant invention is described in more detail below and in the accompanying drawings, in which.

DETAILED DESCRIPTION OF THE PREFERRED EMBODIMENT

Figure 1:
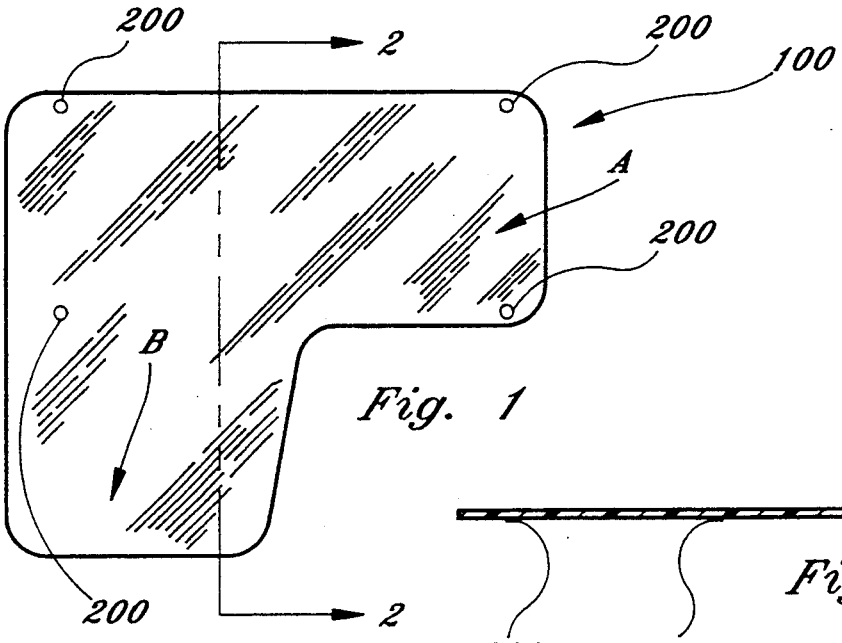
FIG. 1 is a plan view of the fabric rest board of the present invention.

Referring now to the drawings, FIG. 1 is a plan view of the fabric rest board 100 of the present invention. The board 100 is substantially L-shaped with a first, horizontal arm "A" and a second arm "B" extending along the same plane as first arm "A" and substantially perpendicular thereto. The second arm "B" could extend at any angle with respect to the first arm "A" so long as it protrudes between the operator and the serger machine. The first arm "A" might also be hinged (not shown) so it can be folded down/up when the serger machine is not being used.

The instant drawings show a clear plastic fabric rest board. Nonetheless, the fabric rest board could be opaque, and it could be made of any other material so long as it is rigid enough to support the weight of the fabric and the forces applied by the operator.

FIG. 1 shows four tabs 200 which adhere to the bottom of the fabric rest board to contact the table 300 (FIG. 3) or other flat surface on which the fabric rest board is positioned. These tabs 200 are intended to prevent shifting of the fabric rest board if the serger machine vibrates during use. Of course, other means may be used to adhere the fabric rest board 100 to the table 300 or other flat surface. In some instances, such as where the top surface of the table is rough or sticky, or the bottom of the fabric board rest is rough or sticky, the tabs 200 or other means for adhering the fabric rest board to the table might be unnecessary.

Figure 2:
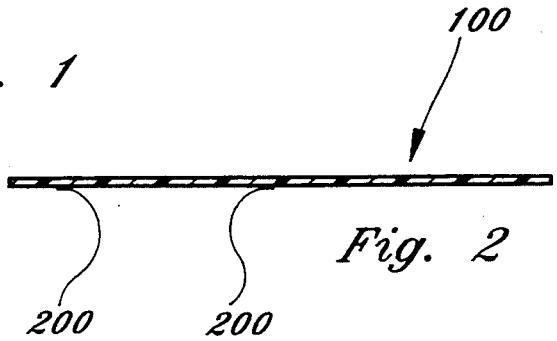
FIG. 2 is a left side view of the fabric rest board shown in FIG. 1, taken along section lines 2—2.

FIG. 2 is a left side view taken along cross section lines 2—2 in FIG. 1. The tabs 200 are shown to project slightly from the bottom of the fabric rest board 100.

Figure 3:
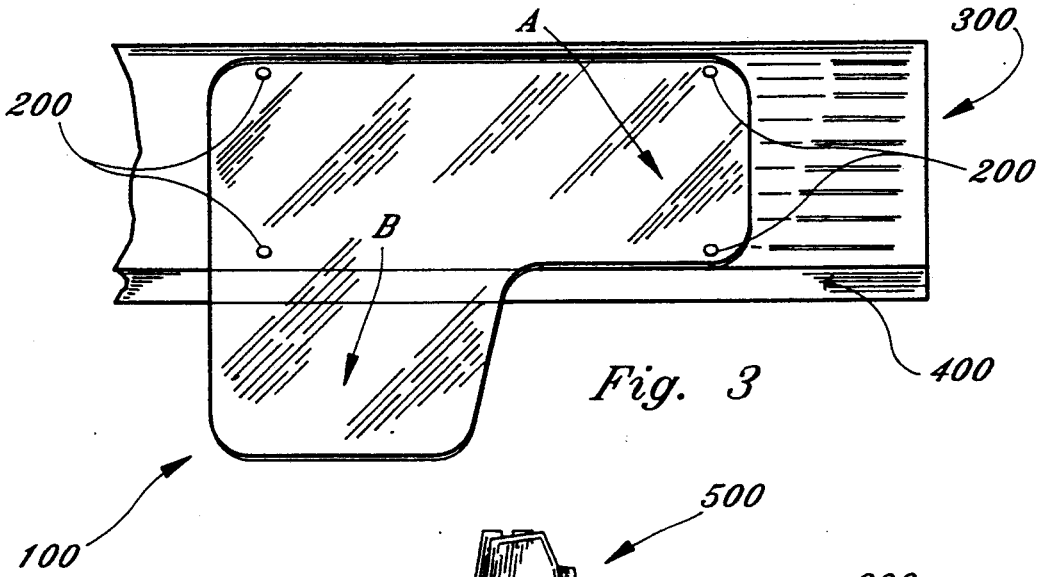
FIG. 3 is a top perspective view of the fabric rest board resting on the edge of a table.
Figure 4:
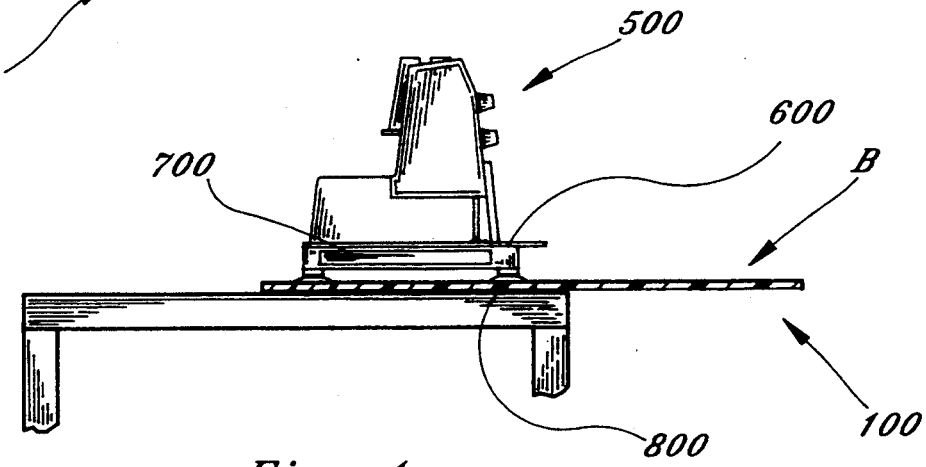
FIG. 4 is a left side view of the fabric rest board secured between a table and a serger machine.
Figure 5:
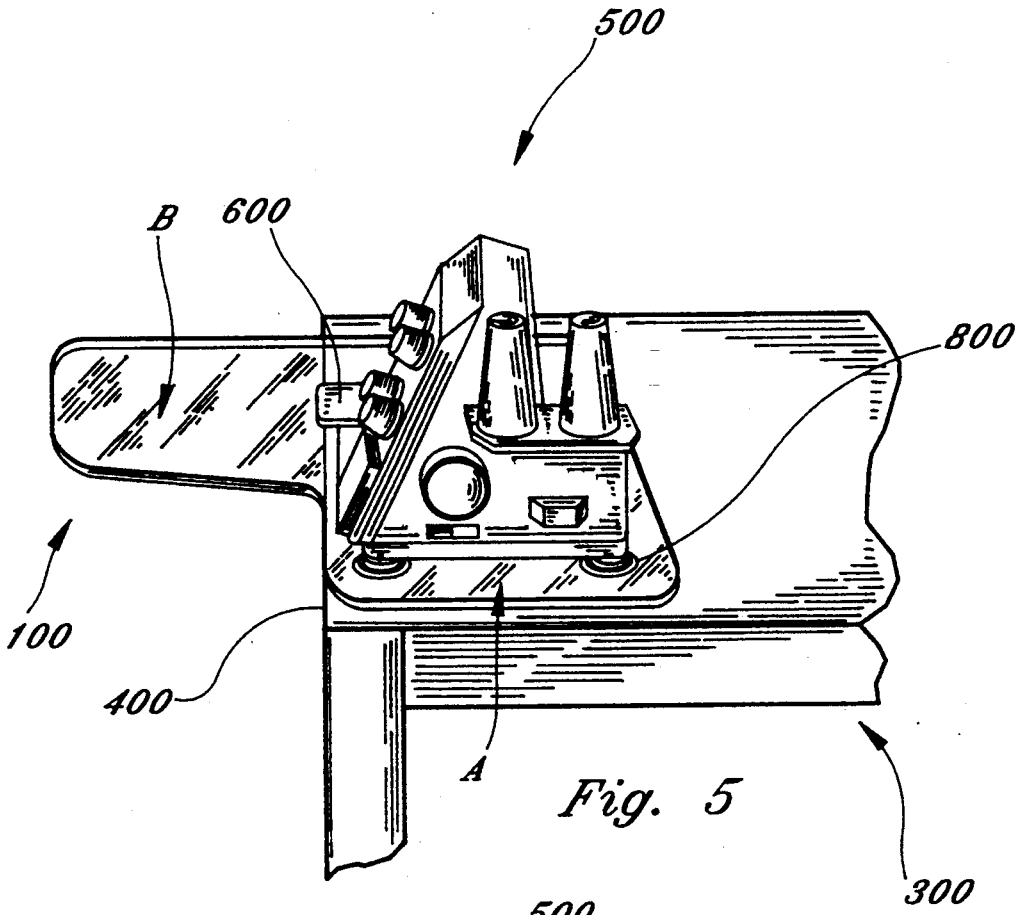
FIG. 5 is a right side perspective view of the fabric rest board secured between the table and the serger machine.
Figure 6:
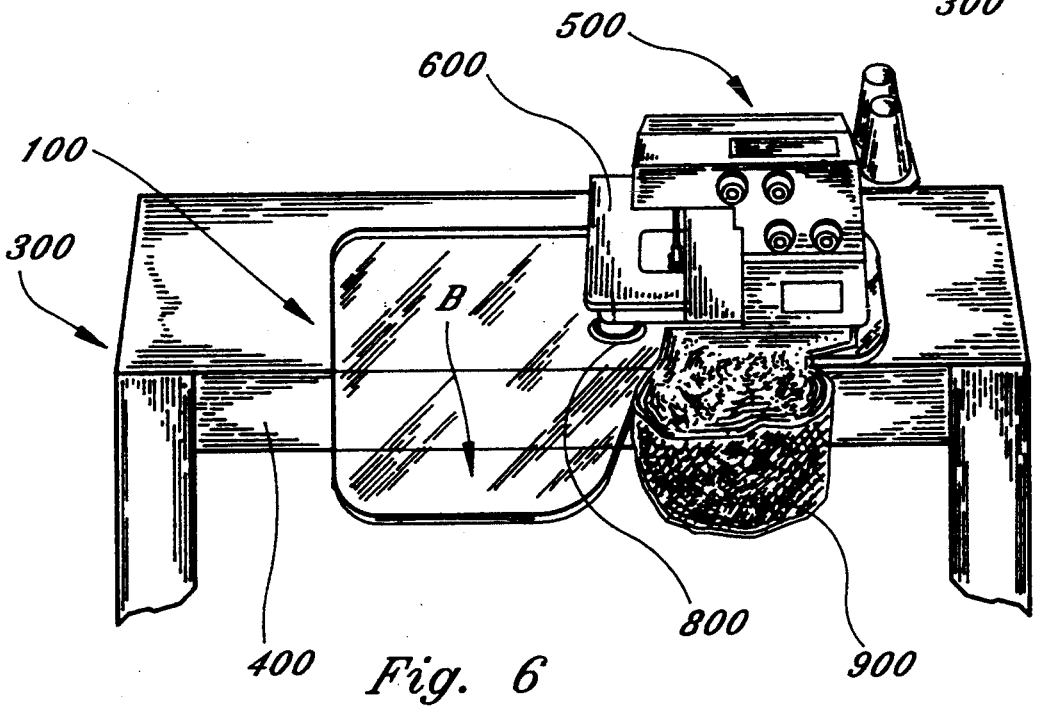
FIG. 6 is a front perspective view of the fabric rest board secured between the table and the serger machine.

FIG. 3 shows the proper positioning of the fabric rest board 100 on the top of a table 300 or other substantially flat surface. The first, horizontal arm "A" is positioned to extend in parallel with and along or adjacent to the edge 400 of the table 300. The second, protruding arm "B" protrudes substantially perpendicular from the first arm "A" and the edge 400 of the table 300. The tabs 200 contact the top surface of the table 300. The L-shaped fabric rest board 100 is positioned in this manner and a serger machine 500 is placed on top of the fabric rest board, as illustrated in FIGS. 4–6. The weight of the serger machine 500 is sufficient to secure the fabric rest board 100 to the table 300 and to allow the operator to rest the fabric (not shown) on the protruding arm "B" of the fabric rest board as the fabric is drawn into the feeder dogs of the serger machine 500.

FIG. 4 is a left side view of the fabric rest board 100 positioned beneath the serger machine 500. The serger machine 500 may be provided with suction cups 800 or other means for adhering the serger machine to the top of the fabric rest board 100. The serger machine 500 is positioned along the edge of the table 300 over the first, horizontal arm "A" of the fabric rest board 100. The bag 900 (see FIG. 6) of the serger machine 500 is removed in FIGS. 4 and 5 for the sake of clarity.

As shown in FIG. 4, the operating (i.e, cutting/sewing) or work surface 600 of the serger machine extends in a plane above the fabric rest board 100 so the operator does not need to remove the fabric rest board 100 to access the access area 700. The access area 700 is typically covered by a hinged cover (not shown) including a tray (also not shown). Thus, the fabric rest board 100 is below the serger machine 500 and remains there throughout operation of the serger machine 500 allowing the operator quick and easy access to the lowermost portion of the serger machine, e.g., to maintain the cutting blade and to remove pieces of fabric that get caught in the machine rather than being deposited in the bag 900 (FIG. 6). Further, as shown in FIG. 6, the L-shaped fabric rest board 100 does not interfere with the bag 900 which hangs in front of and below the serger machine and the front edge 400 of the table 300.

FIG. 5 is a right side, perspective, view of the fabric rest board with a serger machine 500. The operating surface 600 of the serger machine 500 is shown to extend in a plane above the fabric rest board 100, and the serger machine 500 and the horizontal arm "A" of the fabric rest board are shown to be positioned along the front edge 400 of the table 300. The bag 900 is removed in order to improve the clarity of the figure. The protruding arm "B" is shown to extend from the front edge 400 of the table 300 between the operator (not shown) and the serger machine 500.

FIG. 6 is a front perspective view of the fabric rest board 100 secured between the table 300 and the serger machine 500. The bag 900 is shown to extend at the front of the serger machine 500 adjacent to the operating surface 600 for catching cut pieces of fabric during operation of the serger machine 500. The fabric rest board 100 is L-shaped so as not to interfere with the bag 900. The protruding arm "B" extends substantially perpendicular from the edge 400 of the table 300 and is used as a support for the fabric as it is moved away from the operator and through the serger machine 500.

Without the serger board 100 of the present invention, the operator previously had to hold the fabric in his or her lap as the fabric was fed through the serger machine 500 or, more preferably, the operator had to support the fabric between his or her raised knees against the edge 400 of the table 300. These were difficult, awkward and tiresome maneuvers. The instant invention, however, entirely eliminates the need for such maneuvers. Further, the fabric rest board does not require legs or other means which raise the board to the operating surface and restrict the operator's access to the access area 700. The fabric rest board of the present invention is therefore simple in design, cost effective to manufacture, and readily adapted for use with serger machines.

The instant invention has been shown and described herein in what are considered to be the most practical and preferred embodiments. It is recognized, however, that departures may be made therefrom within the scope of the invention and that obvious modifications will occur to a person skilled in the art.

What I claim is:

1. A combination of a fabric rest board, serger machine and work table, said combination comprising:

a rigid, substantially L-shaped, body member defining upper and lower substantially planar surfaces, said L-shaped body member being positioned on a table top, said lower planar surface contacting the table top, one arm of said L-shaped body member extending substantially parallel with, and adjacent to or along, an edge of the table top, the other arm of said L-shaped body member extending substantially perpendicular from the edge of the table top, said serger machine having an operating surface that extends in a plane above a plane defined by the fabric rest board, the serger machine being supported on said upper planar surface of said L-shaped piece along said one arm extending substantially in parallel with, and adjacent to, the edge of the table top.

2. The combination of a fabric rest board, serger machine and work table as recited in claim 1, wherein said rest board comprises a plastic material.

3. The combination of a fabric rest board, serger machine and work table as recited in claim 1, wherein said rest board comprises an opaque material.

4. The combination of a fabric rest board, serger machine and work table as recited in claim 1, wherein said rest board comprises a transparent material.

5. The combination of a fabric, rest board, serger machine and work table as recited in claim 1 further comprising means for securing said rest board against lateral movement relative to said work table.

6. The combination of a fabric rest board, serger machine and work table as recited in claim 1, wherein said angle between said one arm and said other arm is between approximately 45° and 90°.

* * * * *